US008072405B2

(12) United States Patent
Nishitani et al.

(10) Patent No.: US 8,072,405 B2
(45) **Date of Patent: *Dec. 6, 2011**

(54) LIQUID CRYSTAL DISPLAY DEVICE

(75) Inventors: Shigeyuki Nishitani, Mobara (JP); Hideo Sato, Hitachi (JP)

(73) Assignee: Hitachi Displays, Ltd., Chiba (JP)

( * ) Notice: Subject to any disclaimer, the term of this patent is extended or adjusted under 35 U.S.C. 154(b) by 319 days.

This patent is subject to a terminal disclaimer.

(21) Appl. No.: 12/385,936

(22) Filed: Apr. 24, 2009

(65) Prior Publication Data

US 2009/0213059 A1 Aug. 27, 2009

Related U.S. Application Data

(63) Continuation of application No. 11/066,186, filed on Feb. 25, 2005, now Pat. No. 7,561,135.

(30) Foreign Application Priority Data

Mar. 23, 2004 (JP) ..... 2004-084175

(51) Int. Cl.
*G09G 3/36* (2006.01)

(52) U.S. Cl. ..... 345/92; 345/82; 349/41

(58) Field of Classification Search ..... 345/87, 345/92, 93, 95, 98, 99, 100, 204; 349/41, 349/42; 327/333
See application file for complete search history.

(56) References Cited

U.S. PATENT DOCUMENTS

| | | | | |
|---|---|---|---|---|
| 6,094,192 | A | 7/2000 | Kobayashi et al. | |
| 7,012,599 | B2 | 3/2006 | Sun | |
| 7,154,569 | B2 | 12/2006 | Lee et al. | |
| 7,224,336 | B2 | 5/2007 | Katsutani | |
| 7,561,135 | B2 * | 7/2009 | Nishitani et al. | 345/92 |

FOREIGN PATENT DOCUMENTS

| | | |
|---|---|---|
| JP | 10-293559 | 4/1997 |
| JP | 2000-148093 | 11/1998 |
| JP | 2004-163912 | 10/2003 |
| WO | WO 96/37803 | 5/1995 |

* cited by examiner

*Primary Examiner* — Abbas Abdulselam
(74) *Attorney, Agent, or Firm* — Stites & Harbison PLLC; Juan Carlos A. Marquez, Esq.

(57) ABSTRACT

The present invention provides a liquid crystal display device which can recover a charge stored in a liquid crystal display panel without using an exteriorly mounted part such as a coil thus achieving the low power consumption. A display device includes a liquid crystal display panel having a plurality of pixels, a plurality of video lines which apply a video voltage to the plurality of pixels, and a drive circuit which supplies the video voltage to the plurality of video lines. In such a display device, the liquid crystal display panel has a common electrode to which a first voltage and a second voltage having a potential higher than a potential of the first voltage are alternately applied. The liquid crystal display panel further includes a charge recovering circuit which is connected between the respective video lines and a power source line and recovers charge when a voltage applied to the common electrode is changed over from the first voltage to the second voltage or when the voltage applied to the common electrode is changed over from the second voltage to the first voltage.

8 Claims, 6 Drawing Sheets

LIQUID CRYSTAL DISPLAY DEVICE

This application is a Continuation application of U.S. application Ser. No. 11/066,186 filed Feb. 25, 2005 now U.S. Pat. No. 7,561,135. Priority is claimed based on U.S. application Ser. No. 11/066,186 filed Feb. 25, 2005, which claims the priority to Japanese Patent Application No. 2004-084175 filed on Mar. 23, 2004, all of which is incorporated by reference.

BACKGROUND OF THE INVENTION

1. Field of the Invention

The present invention relates to a liquid crystal display device and, more particularly, to a liquid crystal display device which aims at the low power consumption.

2. Description of the Related Art

A TFT (Thin Film Transistor) type liquid crystal display module has been popularly used as a display device of a portable equipment such as a notebook type personal computer or the like. Particularly, the liquid crystal display module which is provided with a miniaturized liquid crystal display panel is used as a display device of a portable equipment such as a mobile phone, for example, which a user always carries.

The portable equipment is required to be operated for a long time by battery driving. Accordingly, the liquid crystal display module which is served for such an application is requested to satisfy the low power consumption.

On the other hand, when the same voltage (DC voltage) is applied to a liquid crystal layer for a long time, a display quality is deteriorated including the occurrence of an image retention phenomenon.

To prevent the deterioration of the image quality, in the liquid crystal display module, the voltage applied to the liquid crystal layer is alternated for every given fixed time. That is, using a voltage applied to a common electrode as the reference, a voltage applied to pixel electrodes is changed to a positive voltage side/a negative voltage side for every fixed time.

As a driving method which applies the AC voltage to the liquid crystal layer, there has been known a common inversion method which alternately inverts the voltage applied to the common electrode and the voltage applied to the pixel electrodes to the positive voltage side and the negative voltage side.

Further, with respect to the liquid crystal display module which is driven by the common inversion method, there has been known a liquid crystal display module which recovers a charge stored in a liquid crystal display panel so as to achieve the low power consumption (International Publication Pamphlet WO96/37803, Japanese Unexamined Patent Publication Hei10 (1998)-293559).

SUMMARY OF THE INVENTION

According to the common inversion method described in the above-mentioned patent literature 1, at the time of changing over the voltage applied to the common electrode, the energy stored in the liquid crystal display panel is recovered by a resonance circuit and a charge storing capacitance, and the recovered energy is used again at the time of performing the next common inversion thus achieving the low power consumption.

Further, according to the common inversion method described in the above-mentioned Japanese Unexamined Patent Publication Hei10 (1998)-293559, immediately before the polarity of the voltage of the common electrode is inverted, the charge stored in the liquid crystal display panel is recovered as the voltage having the same polarity as the common electrode, and the common electrode is driven by the charge which is recovered at the timing that the polarity of the common electrode is converted into the polarity equal to the polarity of the recovered voltage thus achieving the low power consumption.

However, the common inversion methods described in the above-mentioned respective patent literatures have a drawback that an exteriorly mounted coil is necessary which becomes a cause to push up a cost.

The present invention has been made to overcome the above-mentioned drawback of the related art and it is an object of the present invention to provide a technique which can, in a liquid crystal display device, recover a charge stored in a liquid crystal display panel without using an exteriorly mounted part such as a coil thus achieving the low power consumption.

The above-mentioned object, other objects and novel features of the present invention will become apparent in accordance with the description of this specification and attached drawings.

To briefly explain the summary of the typical inventions among the inventions disclosed in this specification, they are as follows.

The present invention is directed to a liquid crystal display device which includes a liquid crystal display panel having a plurality of pixels, a plurality of video lines which apply a video voltage to the plurality of pixels, and a drive circuit which supplies the video voltage to the plurality of video lines, wherein the liquid crystal display panel has a common electrode to which a first voltage and a second voltage having a potential higher than a potential of the first voltage are alternately applied, and the liquid crystal display device includes a charge recovering circuit which is connected between the respective video lines and a power source line and recovers charge when a voltage applied to the common electrode is changed over from the first voltage to the second voltage or when the voltage applied to the common electrode is changed over from the second voltage to the first voltage.

In a preferred embodiment of the present invention, the liquid crystal display device includes first switching elements which are connected between the respective video lines and a power source line and are turned on when the voltage applied to the common electrode is changed over from the first voltage to the second voltage, the video voltage is supplied to the respective video lines from the drive circuit via second switching elements, and the second switching elements are turned off when the first switching elements are turned on.

Further, in a preferred embodiment of the present invention, the liquid crystal display device includes first switching elements which are connected between the respective video lines and a power source line and are turned on when the voltage applied to the common electrode is changed over from the second voltage to the first voltage, the respective video lines supply the video voltage from the drive circuit via second switching elements, and the second switching elements are turned off when the first switching elements are turned on.

According to the present invention, when the voltage applied to the common electrode is changed over from the first voltage to the second voltage or from the second voltage to the first voltage, the voltage of the video lines is largely changed and hence, this voltage is recovered as charge via the first switching elements. The recovered charge is supplied again as the power source of the internal circuit (drive circuit, for example).

To briefly explain advantageous effects obtained by the typical inventions among the inventions disclosed in this specification, they are as follows.

According to the liquid crystal display device of the present invention, it is possible to recover the charge stored in the liquid crystal display panel without using an exteriorly mounted part such as a coil thus achieving the low power consumption.

DESCRIPTION OF THE PREFERRED EMBODIMENT

Hereinafter, embodiments of the present invention are explained in detail in conjunction with drawings.

Here, in all drawings for explaining the embodiments, parts having identical functions are given same symbols and their repeated explanation is omitted.

Embodiment 1

Figure 1:
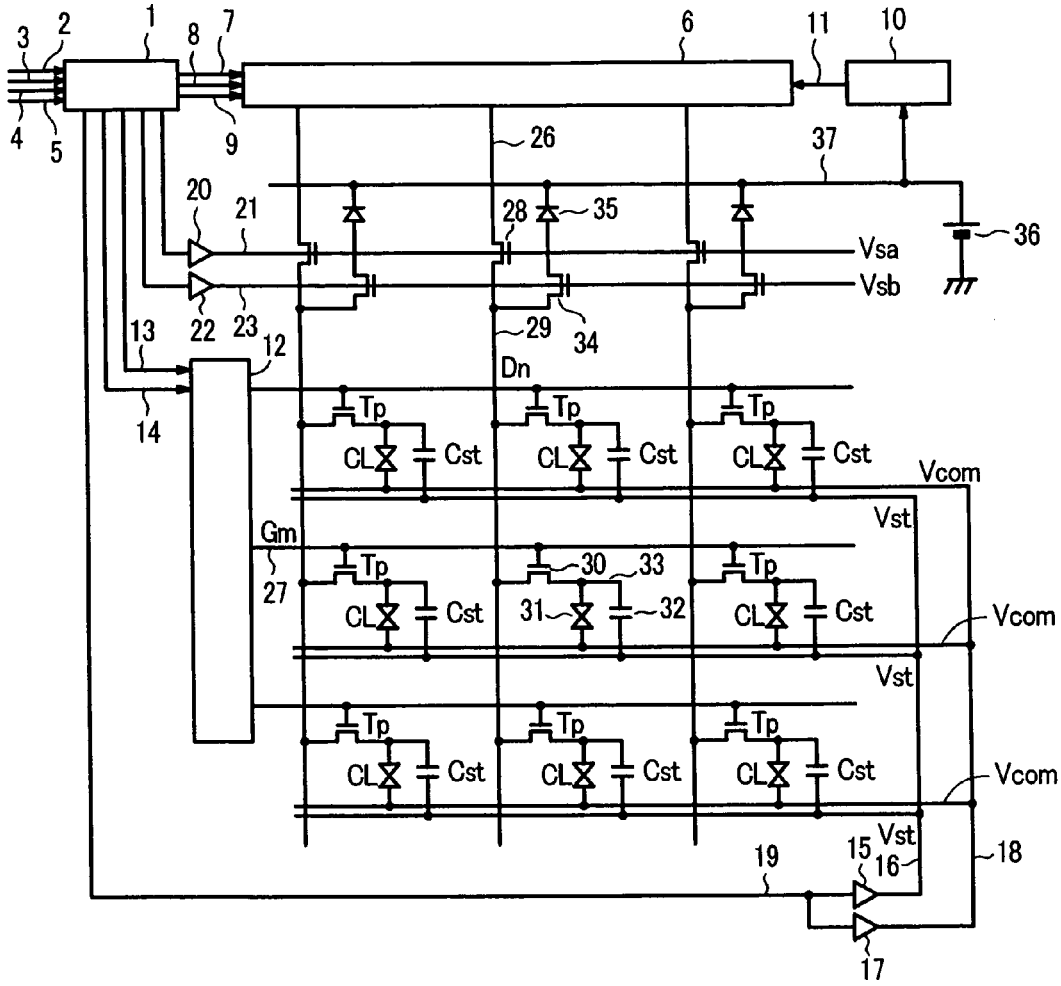
FIG. 1 is a view showing the schematic constitution of a liquid crystal display module of an embodiment 1 of the present invention.

FIG. 1 is a view showing the schematic constitution of a liquid crystal display module of the embodiment 1 of the present invention.

In the drawing, numeral 1 indicates a timing controller, numeral 6 indicates a drain driver, numeral 10 indicates a voltage stabilizing circuit, numeral 12 indicates a gate driver, numeral 15 indicates a storage drive amplifier, numeral 16 indicates a storage electrode, numeral 17 indicates a common amplifier, numeral 18 indicates a common electrode, numeral 20 indicates a drain-line switch drive circuit, numeral 22 indicates a charge recovering switch drive circuit, numeral 27 indicates gate lines (also referred to as scanning lines), numeral 28 indicates a drain line switch TFT, numeral 29 indicates drain lines (also referred to as video lines), numeral 30 indicates a pixel TFT, numeral 31 indicates liquid crystal, numeral 32 indicates storage capacitance, numeral 33 indicates a pixel electrode, numeral 34 indicates a charge recovering switch TFT, numeral 35 indicates a diode, numeral 36 indicates a battery, and numeral 37 indicates a power source line.

It is desirable that the liquid crystal display module of this embodiment is produced by forming low-temperature polysilicon TFTs on a substrate on which the liquid crystal display panel is formed. Particularly, parts except for the drain driver 6, the gate driver 12 and the timing controller 1 can be easily realized using the low-temperature polysilicon TFTs. Further, it is also possible to realize a portion or the whole drain driver 6, the gate driver 12 and the timing controller 1 using the low-temperature polysilicon TFTs. In this case, since the number of parts can be reduced, it is possible to realize the lowering of a cost of the liquid crystal display.

(Explanation of the Operation of the Liquid Crystal Display Module Shown in FIG. 1)

The liquid crystal display module of this embodiment is a TFT liquid crystal display module in which pixels are arranged in a matrix array as shown in FIG. 1, wherein the number of pixels is constituted of 1024×768 dots, for example. In FIG. 1, 3×3 dots are shown for an explanation purpose.

In FIG. 1, three drain lines 29 and three gate lines 27 are arranged to cross each other and pixel TFTs 30 are arranged in the vicinity of the crossing points.

The pixel TFTs 30 have gates thereof connected to the gate line 27, drains thereof connected to the drain line 29, and sources thereof connected to pixel electrodes 33.

A gate selection signal from the gate driver 12 is outputted to the gate lines 27 and is applied to the gates of the pixel TFTs 30 so as to turn on the pixel TFTs 30.

In a state that the pixel TFTs 30 assume an ON state, when a video voltage 26 is applied to the drain lines 29 from the drain driver 6 through the drain line switch TFTs 28, the video voltage is applied to the pixel electrodes 33 through the pixel TFTs 30 and hence, the video voltage is written in the liquid crystal 31 and the storage capacitance 32. Here, the operation of the drain line switch TFTs 28 is described later.

On the other hand, a common electrode 18 is connected to side of the liquid crystal 31 opposite to the pixel electrodes 33, the storage electrode 16 is connected to side of the storage capacitance 32 opposite to the pixel electrodes 33.

Voltages of the common electrode 18 and the storage electrode 16 are controlled in response to a common AC control signal 19 in a state that polarities thereof are sequentially inverted with respect to the pixel voltage written in the pixel electrodes 33 thus realizing the AC driving of the liquid crystal.

Here, in this embodiment, the voltage which is applied to the common electrode 18 via the common amplifier 17 and to the storage electrode 16 via the storage drive amplifier 15 is changed over between the first voltage (VcomL) and the second voltage (VcomH) which has a potential higher than a potential of the first voltage alternately for every one display line.

In this manner, the display is realized in response to the voltage written in the liquid crystal 31 and the storage capacitance 32.

The timing controller 1 receives display data 2, a vertical synchronizing signal 3, a horizontal synchronizing signal 4 and a dot clock 5 from a system of a CPU, a display controller and the like (not shown in the drawing) and outputs respective signals which control the whole liquid crystal display module to respective parts.

The drain driver 6 is operated in response to a horizontal start signal 8 transmitted from the timing controller 1 and fetches display data 7 corresponding to one display line into the inside thereof using a horizontal shift clock 9. Based on the fetched display data corresponding to one line, the drain driver 6 outputs a video voltage 26 corresponding to one display line.

The gate driver 12 is operated in response to a vertical start signal 13 transmitted from the timing controller 1 and sequentially outputs a gate selection signal to the respective gate lines 27 based on the vertical shift clock 14.

The video voltage 26 outputted from the drain driver 6 is supplied to the drain line 29 via the drain line switch TFTs 28. To the gates of the drain line switch TFTs 28, a drain line switch signal 21 transmitted from the timing controller 1 is applied and hence, the drain line switch TFTs 28 receive an ON/OFF control in response to the drain line switch signal 21. Here, in FIG. 1, the drain line switch signal 21 has an electric current thereof amplified by the drain line switch drive circuit 20 and is applied to the drain line switch TFTs 28.

Further, the drain line 29 is connected with a charge recovering switch TFTs 34.

To the gates of the charge recovering switch TFTs 34, a charge recovering switch signal 23 transmitted from the timing controller 1 is applied and hence, the charge recovering switch TFTs 34 receive an ON/OFF control in response to the charge recovering switch signal 23. Here, in FIG. 1, the charge recovering switch signal 23 has an electric current thereof amplified by the charge recovering switch drive circuit 22 and then is applied to the charge recovering switch TFTs 34.

Further, the charge recovering switch TFTs 34 are connected with diodes 35 and the charge which is present on the drain lines 29 is recovered at the power source line 37 via the charge recovering switch TFTs 34 and the diodes 35.

The power source line 37 is connected with the battery 36 and an electric current outputted from the battery 36 is inputted to the voltage stabilizing circuit 10 together with the recovered charge and is converted into a stabilized voltage and, thereafter, is supplied to the drain driver 6 as a drain driver power source 11.

(Explanation of Equivalent Circuit)

Figure 2:
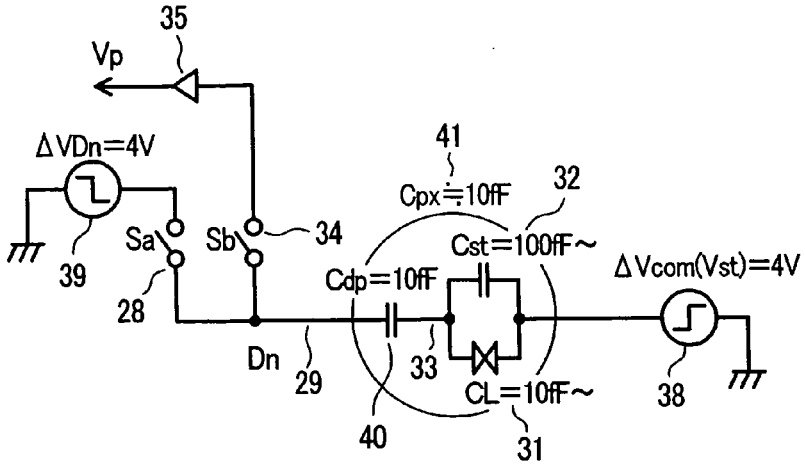
FIG. 2 is a circuit diagram showing an equivalent circuit of the liquid crystal display module of the embodiment 1 of the present invention.

FIG. 2 is a circuit diagram showing the equivalent circuit of the liquid crystal display module of this embodiment. In FIG. 2, parts identical with the parts shown in FIG. 1 are given same symbols.

In FIG. 2, numeral 38 indicates a power source and the power source 38 is the equivalent expression of the storage drive amplifier 15 and the common amplifier 17 in FIG. 1.

At the timing that the common voltage (Vcom) which is applied to the common electrode 18 is inverted, the voltage applied to the storage electrode 16 is also inverted and hence, the storage drive amplifier 15 and the common amplifier 17 are indicated by one power source 38 in appearance.

Numeral 39 indicates a power source and this power source 39 also equivalently expresses the drain driver 6 shown in FIG. 1.

The power source 38 is equivalently connected with the storage capacitance 32 and the liquid crystal 31.

Further, numeral 40 indicates parasitic capacitance, that is, parasitic capacitance between the source and the drain of the pixel TFT 30, which is connected between the pixel electrode 33 and the drain line 29.

Further, the drain line switch TFT 28 and the charge recovering switch TFT 34 are respectively expressed by switch symbols Sa, Sb.

In the equivalent circuit in FIG. 2, the liquid crystal capacitance of the liquid crystal 31 and the storage capacitance 32 are connected in parallel and, further, the parasitic capacitance 40 is connected with the liquid crystal capacitance of the liquid crystal 31 and the storage capacitance 32 in series.

With respect to the respective capacitances, the liquid crystal capacitance of the liquid crystal 31 is equal to or more than 10 fF, the storage capacitance 32 is equal to or more than 100 fF, and the parasitic capacitance 40 is approximately 10 fF and hence, a total resultant capacitance of these capacitances, that is, a pixel capacitance 41 is dominated by the parasitic capacitance 40 and becomes approximately 10 fF.

(Explanation of the Whole Driving Waveforms)

Figure 3:
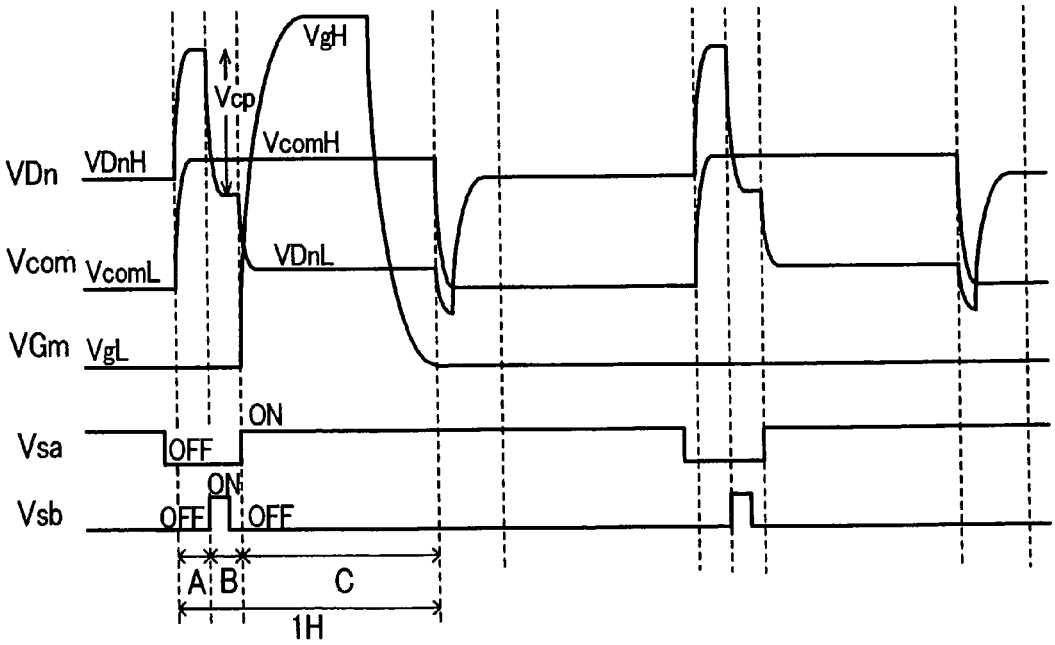
FIG. 3 is a view showing driving waveforms for explaining an operation of the liquid crystal display module of the embodiment 1 of the present invention.

FIG. 3 is a view showing driving waveforms for explaining the operation of the liquid crystal display module of this embodiment. In FIG. 3, symbol VDn indicates a voltage of the drain line 29, symbol Vcom indicates a voltage applied to the common electrode 18, symbol VGm indicates a voltage applied to the gate line 27, symbol Vsa indicates a drain line switch signal 21, and symbol Vsb indicates a charge recovering switch signal 23.

As shown in FIG. 3, the explanation is made with respect to a case in which one horizontal period (1H) is divided into three periods.

That is, these periods are the period A in which the voltage (Vcom) applied to the common electrode 18 is inverted from VcomL to VcomH, the period B in which the charge is recovered, and the period C in which the gray scale voltage is written in the pixel.

In the period A, since both of the drain line switch signal 21 and the charge recovering switch signal 23 assume an OFF state, both of the drain line switch TFT 28 and the charge recovering switch TFT 34 assume an OFF state and hence, when the voltage of the common electrode 18 is changed from VcomL to VcomH, the voltage of the drain line 29 is elevated via the pixel capacitance 41.

Next, in the period B, since the charge recovering switch signal 23 assumes an ON state, the charge recovering switch TFT 34 assumes an ON state and hence, a potential of the drain line 29 is lowered to a potential which is obtained by applying a forward bias voltage of the diode 35 to a voltage of the power source line 37. In FIG. 3, this lowering amount of voltage is expressed by symbol Vcp.

This implies that the charge stored in the pixel capacitance 41 passes through the charge recovering switch TFT 34 and flows into the power source line 37 via the diode 35. Accordingly, it is possible to partially recover the charge of the pixel capacitance 41.

Next, in the period C, the charge recovering switch signal 23 assumes the OFF state, the charge recovering switch TFT 34 assumes the OFF state, the drain line switch signal 21 assumes the ON state and the drain line switch TFT 28 assumes the ON state. Accordingly, the video voltage (VDnL) from the drain driver 6 is outputted to the drain line 29.

Further, by allowing the gate line 27 to assume the ON state and the voltage of the gate line 27 to assume VgH, the video voltage 26 outputted from the drain driver 6 is written in the pixel electrode 33.

Here, the electric power which can be recovered is explained in conjunction with a trial calculation which inventors of the present invention have carried out.

As conditions, it is assumed that the liquid crystal performs a white display in a state that the voltage is not applied to the liquid crystal, that is, the liquid crystal is normally white liquid crystal and the display condition is that whole screen is black display. Further, it is assumed that the display resolution of the liquid crystal panel is 320×240 pixels×3 (RGB) and the frame frequency which drives the liquid crystal is 60 Hz.

Under such conditions, since the pixel capacitance 41 of one pixel is approximately 10 fF, the capacitance of the whole liquid crystal panel as viewed from the common electrode is expressed by the following formula (1).

$$10\ \text{fF}\times320\times240\times3=2300\ \text{pF} \quad (1)$$

Firstly, the voltage of the common electrode is elevated by 4V with respect to the drain line voltage 4V and hence, the drain line voltage is elevated to 8V in total. Next, by performing the charge recovering operation, the drain line voltage is lowered to 3.6V. Accordingly, the recovered charge quantity is expressed by the following formula (2).

$$2300\ \text{pF}\times(8\text{V}-3.6\text{V})=10.12\ \text{nC} \quad (2)$$

Next, the line inversion period becomes 69.4 μs since the line inversion period is calculated as 60 Hz×240Line. By allocating 3% of this period to the charge recovering period, that is, the period B, the electric current which flows during this period is expressed by the following formula (3).

$$10.12\ \text{nC}/(69.4\ \mu\text{s}\times3\%)=486.1\ \mu\text{A} \quad (3)$$

In the common inversion method of this embodiment, since the common voltage is inverted for every one display line, it is possible to recover the charge one time for every two display lines.

Accordingly, to convert the charge into the average electric current of one frame, the electric current is expressed by the following formula (4).

$$486.1\ \mu\text{A}\times69.4\ \mu\text{s}\times30\%/(69.4\ \mu\text{s}\times2\text{Line})=72.9\ \mu\text{A} \quad (4)$$

Accordingly, the recovered electric power is expressed, assuming that the voltage at the time of recovering the charge is 3.6V measured as the voltage of the battery 36, by the following formula (5).

$$72.9\ \mu\text{A}\times3.6v=0.262\ \text{mW} \quad (5)$$

Here, the electric power which the common amplifier 17 to which the present invention is not applied charges and discharges the capacitance of the whole liquid crystal panel is expressed by the following formula (6).

$$2300\ \text{pF}\times8\text{V}/(69.4\ \mu\text{s}\times2\text{Line})\times4\text{V}=0.530\ \text{mW} \quad (6)$$

Accordingly, the electric power recovering effect obtained by the present invention is understood as an effect which can recover the electric power of approximately 50% of the electric power which charges and discharges the whole capacitance of the liquid crystal panel.

Further, the voltage of the drain line 29, after the electric power is recovered, is lowered by a voltage Vcp and hence, the drain driver 6 may be driven from the voltage which is lowered by Vcp to the voltage VDnL.

Accordingly, a voltage amplitude that the drain driver 6 drives the drain line 29 is also lowered and hence, the power consumption of the drain driver 6 can be also lowered.

(Modification of Driving Timing)

Figure 4:
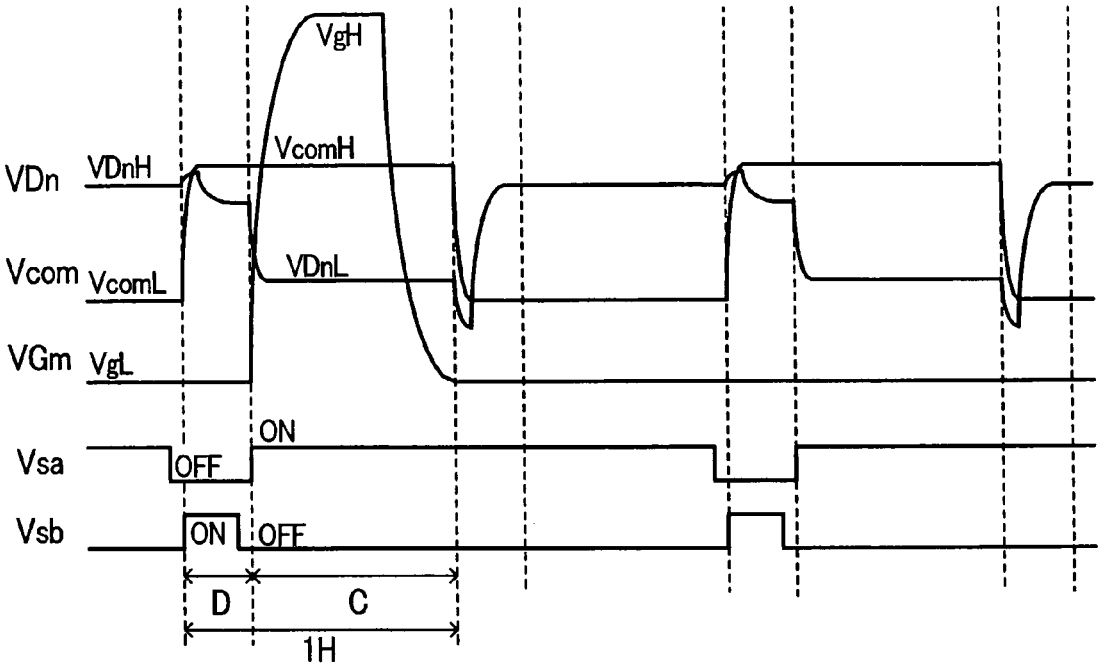
FIG. 4 is a view showing a modification of the driving waveforms for explaining an operation of the liquid crystal display module of the embodiment 1 of the present invention.

In the driving waveforms shown in FIG. 3, the drive method may be modified such that the period A and the period B are united to form one period and the common inversion and the recovery of the charge are performed simultaneously. The driving waveforms in such a modification are shown in FIG. 4.

One horizontal period is divided into two periods and these two periods are constituted of the period D in which the common inversion and the recovery of the charge are performed and the period C in which the gray scale voltage is written in the pixel.

By turning on the charge recovering switch signal 23 along with the common inversion, the charge stored in the pixel capacitance 41 passes through the charge recovery switch TFT 34 and flows into the power source line 37 via the diode 35. Accordingly, the potential of the drain line 29 is hardly elevated and hence, it is possible to recover a portion of the charge. Further, an electric power recovering effect which is obtainable here is equal to the above-mentioned electric power recovering effect.

As has been explained heretofore, according to the present invention, assuming that the equivalent capacitance in the QVGA type liquid crystal panel is 2300 pF, the regenerated charge quantity becomes 10.12 nC. When this charge quantity is converted into the average current value, the average current value becomes 72.9 μA and hence, the electric power of 0.262 mW can be recovered.

The electric power which the drain driver 6 requires for charging and discharging of the liquid crystal panel, when the present invention is not applied, is 0.53 mW and hence, approximately 50 percent of the electric power can be recovered.

Further, since the potential of the drain line after the electric power is recovered is lowered, a voltage amplitude which the liquid crystal driver drives thereafter can be lowered and hence, the power consumption of the liquid crystal driver can be lowered.

Embodiment 2

According to the present invention, it is possible to incorporate the circuit portion which recovers the charge in the drain driver. In this case, the pixel portion may be formed of a low-temperature polysilicon TFT or an amorphous silicon TFT.

By incorporating the circuit portion which recovers the charge in the drain driver 6, the increase of the number of parts which may be induced by carrying out the present invention can be obviated.

Further, with respect to a recent liquid crystal driver which is used in a liquid crystal display module for a recent mobile phone, there exists a liquid crystal driver which incorporates a display memory (frame memory) in the inside of the driver.

By incorporating the frame memory in the inside of the driver, in performing a still image display whose display content is not changed, the display data is read out from the frame memory and the liquid crystal is driven based on the display data.

Accordingly, the power consumption of the liquid crystal display module is restricted to only the reading out of the frame memory and driving of the liquid crystal, that is, the electric power for charging and discharging the liquid crystal and hence, the liquid crystal display module which incorporates the frame memory in the inside of the driver has the feature that the module can largely reduce the power consumption.

By applying the present invention to the liquid crystal display module which incorporates such a frame memory in the inside of the driver, the electric power required for charging and discharging the liquid crystal can be reduced by 50%, whereby it is possible to realize the further reduction of the power consumption.

Figure 5:
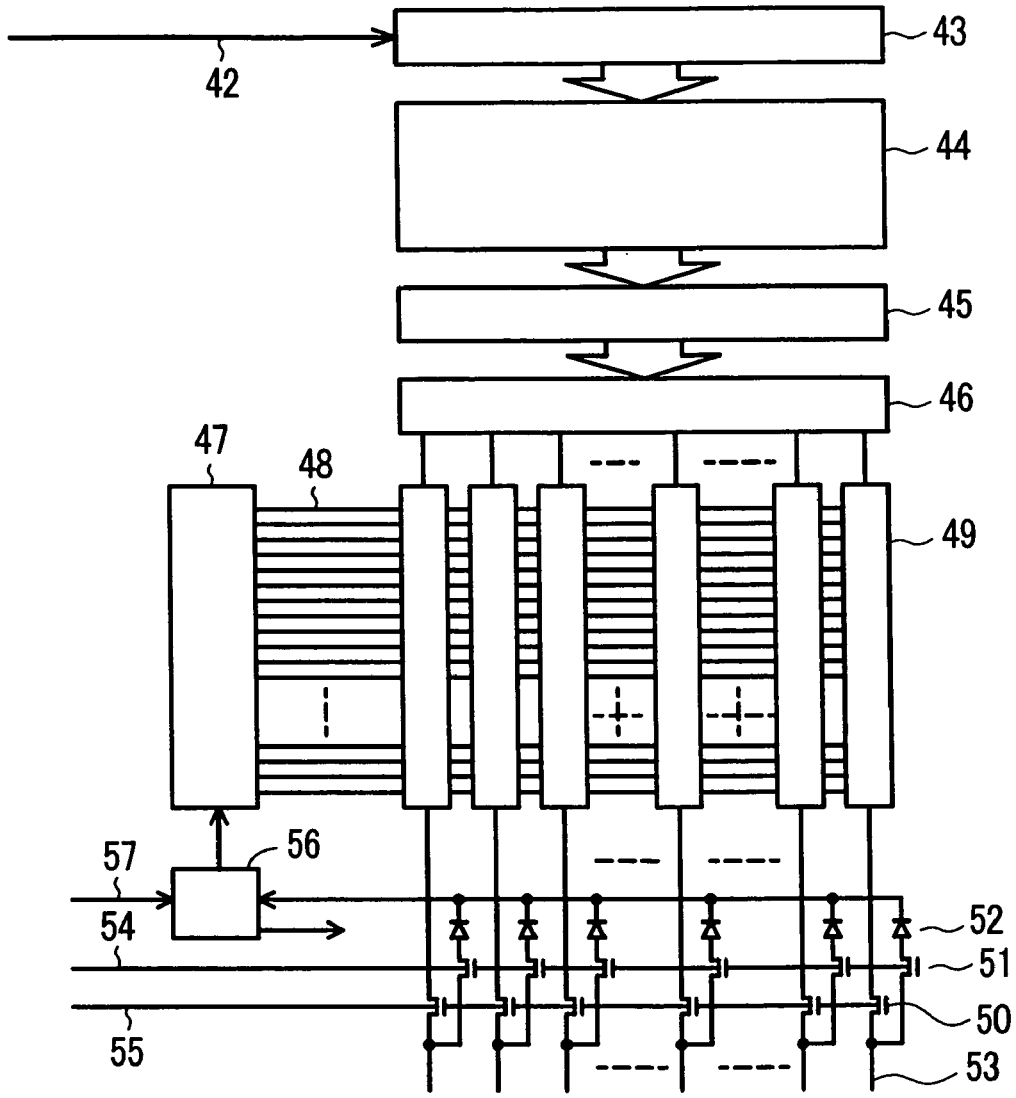
FIG. 5 is a block diagram showing the constitution of a drain driver of a liquid crystal display module of an embodiment 2 of the present invention.

FIG. 5 is a block diagram showing the constitution of the drain driver of the liquid crystal display module of the embodiment 2 of the present invention. The drain driver shown in FIG. 5 is an example of the frame memory incorporated (built-in) liquid crystal driver to which the circuit for recovering the charge according to the present invention is applied.

In FIG. 5, display data 42 is fetched by a memory writing circuit 43 and, thereafter, is written in a given address of a frame memory 44.

Next, the display data stored in the frame memory 44 is read out in accordance with the driving timing of the liquid crystal by a memory readout circuit 45 and is temporarily held in a data latch circuit 46 as the display data for one line.

On the other hand, a gray scale voltage generating circuit 47 is a circuit which generates a plurality of gray scale voltages 48 necessary for the gray scale display and, for example, 64 pieces of gray scale voltages 48 are generated.

Next, selectors (also referred to as decoders) 49, out of 64 pieces of gray scale voltages 48, respectively select one gray scale voltage for each in response to the display data held in the data latch circuit 46 and output the gray scale voltages to drain lines 53.

Further, the circuit for recovering the charge is, in the same manner as the above-mentioned embodiment 1, constituted of MOS transistors (50, 51) and a diode 52.

At the time of performing the common inversion driving, control signals (54, 55) are respectively controlled such that the MOS transistor 50 assumes an OFF state and the MOS transistor 51 assumes an ON state.

Accordingly, the charge at the time of common inversion which appears on a drain line 53 is recovered by a power source circuit 56 through the MOS transistor 51 and the diode 52.

The power source circuit 56 receives the supply of electric power from an external power source via a power source terminal 57 and, at the same time, the power source circuit 56 also receives the supply of electric power attributed to the charge recovered at the time of performing the common inversion driving.

Then, the power source circuit 56 supplies the electric power to respective parts in the inside of the frame-memory-incorporating drain driver including the gray scale voltage generating circuit 47.

As described above, since the electric power which charges and discharges the liquid crystal panel can be recovered at the time of performing the common inversion driving, it is possible to realize the low power consumption of the liquid crystal display module which incorporates the frame memory in the inside of the driver.

Embodiment 3

In the above-mentioned respective embodiments, the explanation has been made with respect to the circuit which recovers the positive-polarity charge when the common voltage (Vcom) in the common inversion driving is changed in the plus direction.

In this embodiment, the explanation is made with respect to a circuit which recovers a negative-polarity charge when the common voltage is changed in the minus direction.

Figure 6:
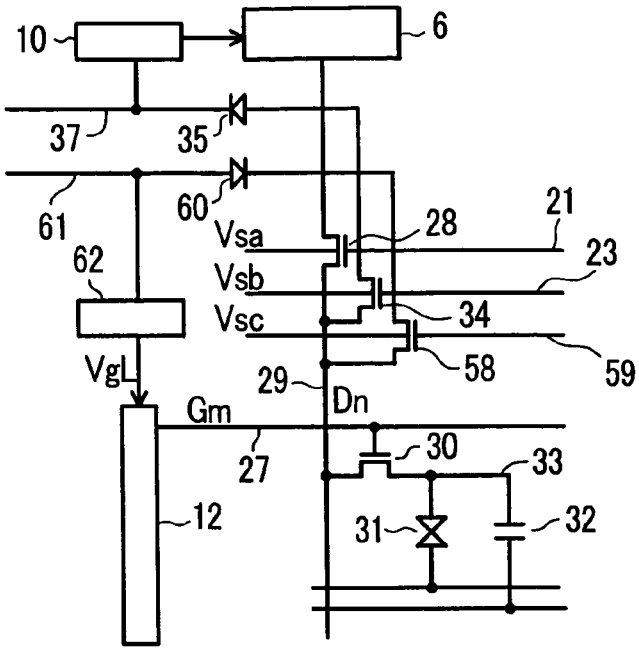
FIG. 6 is a view showing the schematic constitution of a liquid crystal display module of an embodiment 3 of the present invention.

FIG. 6 is a view showing the schematic constitution of the liquid crystal display module of the embodiment 3 according to the present invention. Parts identical with the parts of the above-mentioned embodiment 1 are given same symbols.

Figure 7:
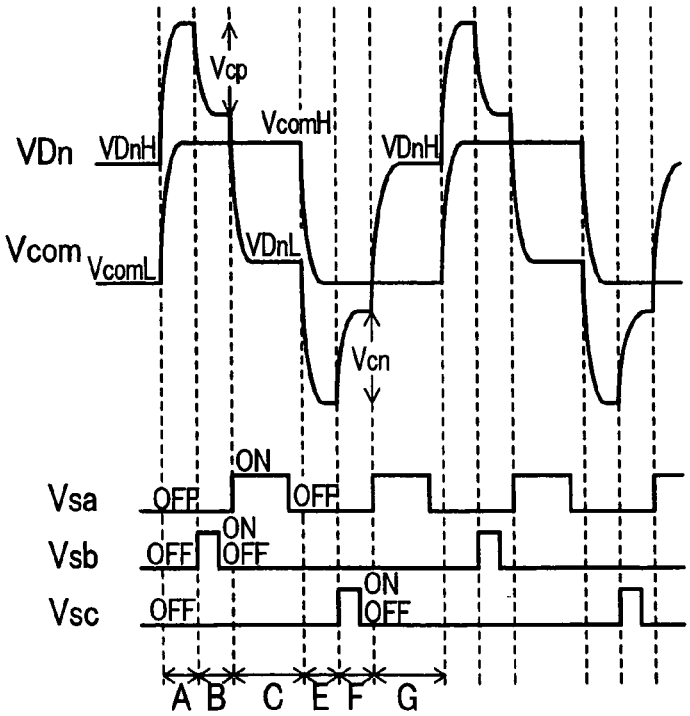
FIG. 7 is a view showing driving waveforms for explaining an operation of the liquid crystal display module of the embodiment 3 of the present invention.

Further, FIG. 7 is a view showing driving waveforms used in this embodiment. Here, in FIG. 7, symbol VDn indicates a voltage of the drain line 29, symbol Vcom indicates a voltage applied to the common electrode 18, symbol Vsa indicates a drain line switch signal 21, and symbol Vsb indicates a charge recovering switch signal 23, and symbol Vsc indicates a negative-polarity charge recovering switch signal 59.

An operation to recover the positive charge when the common voltage (Vcom) which is applied to the common electrode 18 is changed in the plus direction, that is, from VcomL to VcomH, is equal to the operation performed in the embodiment 1.

The positive charge which appears on the drain line 29 is recovered by the positive-polarity power source through the charge recovering switch TFT 34 and the diode 35 and is supplied to the drain driver 6 through the voltage stabilizing circuit 10.

On the other hand, during a period E in which the common voltage (Vcom) applied to the common electrode 18 is changed in the minus direction, that is, from VcomH to VcomL, by turning off all of the drain line switch signal 21, the charge recovering switch signal 23 and the negative-polarity charge recovering switch signal 59, the negative voltage appears on the drain line 29.

Next, during a period F, with respect to the negative voltage which appears on the drain line 29 by turning on the charge recovering switch TFT 58, the charge is recovered by a negative-polarity power source line 61 through the diode 60.

Then, the negative voltage is stabilized by a constant voltage power source 62 and is supplied to the gate driver 12.

Accordingly, it is possible to recover the negative-polarity charge when the common voltage is changed in the minus direction at the time of performing the common inversion driving and hence, the liquid crystal display module which exhibits the low power consumption can be realized.

Figure 8:
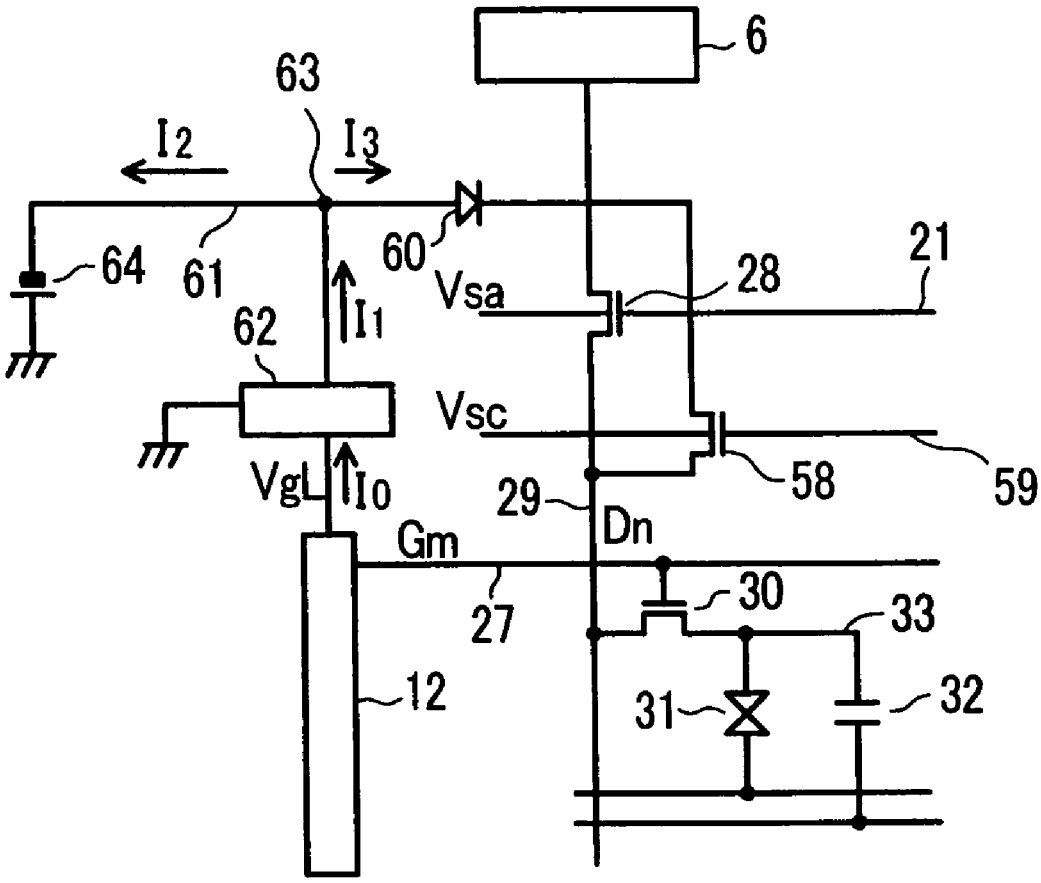
FIG. 8 is a view for explaining an operation to recover a negative electric current in the liquid crystal display module of the embodiment 3 of the present invention.

Further, the detailed explanation of the operation to recover the negative current is made in conjunction with FIG. 8.

In FIG. 8, numeral 63 indicates a node and numeral 64 indicates a negative-polarity power source. Here, the negative-polarity power source 64 may be constituted by converting a power source which is originally positive-polarity power source such as the battery, for example into the negative-polarity power source 64 using a switching regulator and a charge pump. Further, as the negative-polarity power source 64, it may be possible to use a battery which is directly connected with the negative polarity.

Further, directions of electric currents $I_0$, $I_1$, $I_2$, $I_3$ which flow in respective nodes are indicated by arrows. Due to the negative-polarity power source system, the flowing electric current flows to the power source from loads.

Here, considered is a conventional liquid crystal display panel which is not provided with the system consisting of the diode 60, the charge recovering switch TFT 58 and the negative-polarity charge recovering switch signal 59.

In this case, the electric current $I_2$ which flows in the negative-polarity power source 64 becomes equal to the electric current $I_1$ which flows out from the constant voltage power source 62.

The constant voltage power source 62 is a power source for generating a gate-off voltage (VgL) which the gate driver 12 outputs.

The electric current $I_0$ which flows in the constant voltage power source 62 from the gate driver 12 is the negative-polarity power source side consumed electric power which the gate driver 12 consumes. Further, in general, the relationship $I_0<I_1$ is established and the difference between these currents becomes the voltage conversion efficiency of the constant voltage power source 62.

Here, although the constant voltage power source 62 may be incorporated in the gate driver 12, FIG. 8 shows the case in which the constant voltage power source 62 is separated from the gate driver 12. Further, it is also possible to adopt the constitution in which the constant voltage power source 62 per se is not provided and the voltage (VgL) is directly generated by the negative-polarity power source 64.

In this case, in the conventional panel, the electric current $I_2$ which flows in the negative-polarity power source 64 is equal to the electric current $I_1$ which is obtained by adding the electric current corresponding to the voltage conversion efficiency of the constant voltage power source 62 to the electric current $I_0$ consumed by the gate driver 12 ($I_2=I_1$)

Next, considered is a case to which this embodiment is applied. In this embodiment, there exists the system which consists of the diode 60, the charge recovering switch TFT 58 and the negative-polarity charge recovering switch signal 59.

The operation of this embodiment is explained in conjunction with FIG. 7.

During the period E in which the common voltage (Vcom) applied to the common electrode 18 is changed in the minus direction, that is, from VcomH to VcomL, the potential of the drain line 29 becomes further lower than VcomL.

Next, during the period F, by turning on the negative-polarity charge recovering switch signal 59 and by turning on the charge recovering switch TFT 58, the electric current $I_3$ flows out from the node 63 via the diode 60. Due to this electric current $I_3$, the potential of the drain line 29 is elevated by the voltage Vcn.

Accordingly, the electric current $I_2$ which flows in the negative-polarity power source 64 becomes equal to an electric current which is obtained by subtracting the electric current $I_3$ which flows out to the diode 60 from the electric current $I_1$ which flows in the constant voltage power source 62 ($I_2=I_1-I_3$).

In this manner, the electric current $I_2$ which flows in the negative-polarity power source 64 is reduced by an amount of the electric current $I_3$ which flows in the diode 60 compared to the conventional liquid crystal display panel and hence, this embodiment can obtain an advantageous effect that the electric power consumed by the negative-polarity power source 64 is reduced.

Further, since the potential of the drain line 29 is elevated by the voltage Vcn, with respect to the voltage amplitude which the drain driver drives, it is sufficient to drive the voltage which ranges from the voltage elevated by the voltage Vcn to the voltage VDnH. Accordingly, this embodiment can also obtain an advantageous effect that the electric power which the drain driver 6 consumes can be reduced.

Although the invention made by the inventors have been specifically explained heretofore based on the above-mentioned embodiment, it is needless to say that the present invention is not limited to the above-mentioned embodiment and various modifications are conceivable without departing from the gist of the present invention.

What is claimed is:

1. A liquid crystal display device comprising;

a liquid crystal display panel having a plurality of pixels;

a plurality of video lines which apply a video voltage to the plurality of pixels; and a drive circuit which supplies the video voltage to the plurality of video lines, wherein the liquid crystal display panel has a common electrode to which a first voltage and a second voltage having a potential higher than a potential of the first voltage are alternately applied, the liquid crystal display device includes first switching elements which are connected between the respective video lines and a power source line and are turned on when a voltage applied to the common electrode is changed over from the first voltage to the second voltage, the video voltage is supplied to the respective video lines from the drive circuit via second switching elements, the second switching elements are turned off when the first switching elements are turned on, diode elements are connected between the first switching elements and the power source line, and a flow direction of an electric current in the diode elements is a direction directed from the first switching elements to the power source line.

2. A liquid crystal display device according to claim 1, wherein the first switching elements, the diode elements and the second switching elements are arranged in the inside of the drive circuit.

3. A liquid crystal display device according to claim 1, wherein the liquid crystal display device includes a timing controller which controls the first switching elements and the second switching elements.

4. A liquid crystal display device according to claim 1, wherein the first switching elements, the diode elements and the second switching elements are integrally formed on a substrate on which the liquid crystal display panel is formed using thin film transistors.

5. A liquid crystal display device comprising:

a liquid crystal display panel having a plurality of pixels; a plurality of video lines which apply a video voltage to the plurality of pixels; and a drive circuit which supplies the video voltage to the plurality of video lines, wherein the liquid crystal display panel has a common electrode to which a first voltage and a second voltage having a potential higher than a potential of the first voltage are alternately applied, the liquid crystal display device includes first switching elements which are connected between the respective video lines and a power source line and are turned on when a voltage applied to the common electrode is changed over from the second voltage to the first voltage, the video voltage is supplied to the respective video lines from the drive circuit via second switching elements, the second switching elements are turned off when the first switching elements are turned on, and diode elements are connected between the first switching elements and the power source line, and a flow direction of an electric current in the diode elements is a direction directed from the power source line to the first switching elements.

6. A liquid crystal display device according to claim 5, wherein the first switching elements, the diode elements and the second switching elements are arranged in the inside of the drive circuit.

7. A liquid crystal display device according to claim 5, wherein the liquid crystal display device includes a timing controller which controls the first switching elements and the second switching elements.

8. A liquid crystal display device according to claim 5, wherein the first switching elements, the diode elements and the second switching elements are integrally formed on a substrate on which the liquid crystal display panel is formed using thin film transistors.

* * * * *